US005875827A

United States Patent [19]

Brutscher et al.

[11] Patent Number: 5,875,827

[45] Date of Patent: Mar. 2, 1999

[54] ROUTER TABLE PUSH SHOE

[75] Inventors: David T. Brutscher, Louisville; John P. Spiegelhalter, Prospect, both of Ky.

[73] Assignee: Vermont American Corporation

[21] Appl. No.: 51,081

[22] PCT Filed: Oct. 25, 1996

[86] PCT No.: PCT/US96/16821

§ 371 Date: Jun. 10, 1998

§ 102(e) Date: Jun. 10, 1998

[87] PCT Pub. No.: WO97/17175

PCT Pub. Date: May 15, 1997

[51] Int. Cl.[6] ..... B27F 1/00; B27L 13/00; B27B 31/00; B27C 1/12

[52] U.S. Cl. ..... 144/253.1; 33/197; 33/464; 33/501; 83/729; 83/435.15; 83/436.2; 83/522.25; 83/875; 144/86; 144/87; 144/253.2; 144/371

[58] Field of Search ..... 33/197, 201, 464, 33/466, 501, 859, 645, 677, 679; 83/435.15, 436.2, 522.11, 522.25, 707, 719, 729, 425; 144/136.1, 87, 89, 136.93, 253.1, 253.2, 371, 85, 137, 86

[56] References Cited

U.S. PATENT DOCUMENTS

| | | | |
|---|---|---|---|
| 278,815 | 6/1883 | Orum | 144/253.1 |
| 2,771,920 | 11/1956 | Ambelang | 144/253.1 |
| 2,777,485 | 1/1957 | Farrow | 144/253.1 X |
| 3,606,916 | 9/1971 | Day | 144/87 |
| 4,370,909 | 2/1983 | Jennings | 83/707 |
| 4,485,711 | 12/1984 | Schnell . | |

*Primary Examiner*—W. Donald Bray

[57] ABSTRACT

The router table push shoe 10 of the present invention has an upwardly extending handle 11 which is angled slightly towards the operator and away from the router table fence 55. The push shoe of the present invention comes with an adjustable bottom guard 20 removably attached to the base 40, and an adjustable side guard 12 which can be removed and used as a bit height measuring tool. Both the bottom guard 20 and the side guard 12 are adjustable to enable the push shoe 10 to hold thin and narrow stock. The push shoe 10 also comes equipped with a miter bar 30. The horizontally adjustable bottom guard 20 is removably attached to the base 40 via a three wing knob 22. The push shoe also has formed in the front right corner a dovetail gauge 17 for making both male and female joints for sliding dovetail joints. All of these attachments allow the push shoe 10 to be used as a push shoe and also as a miter gauge, depth of bit height reference, a scale to check the distance from the router bit to the fence, and a gauge for making ½" sliding dovetail joints.

14 Claims, 13 Drawing Sheets

ROUTER TABLE PUSH SHOE

BACKGROUND OF THE INVENTION

The present invention relates to tools and accessories which are used in conjunction with a router table and more particularly to an accessory, such as a push shoe, which enables the operator of a router tool to feed stock to the router bit in a safe manner.

Push shoes for router tables are generally well known. Normally, an operator of a router table uses either extra stock or other material as a push shoe to press against the stock which is being worked upon in order to properly and safely feed the stock into the router bit. The stock is placed against a fence and is pushed along that fence toward the router bit so the bit can act upon the stock in an even manner. Push shoes are utilized to keep the operator's hands away from the router bit. Extra stock can be used or other appendages which press firmly against the stock to be worked upon and allow the operator to properly feed it to the bit. A problem associated with the push shoes of the prior art, is their inability to allows the operator to adjust the push shoe to varying height and width stock. Additionally, nothing in the prior art provides a router table accessory which allows the operator to combine a miter gauge, bit height measuring tool and dovetail gauge in a single adjustable push shoe.

The object of the present invention is to provide a router table push shoe that can be adjusted to varying height and width stock, and can also be used as a miter gauge, a depth of bit height reference, a scale to check distance from the router bit to the fence, and a gauge for making thru dovetail joints.

SUMMARY OF THE INVENTION

According to the present invention there is provided a router table accessory which enables the operator to properly and safely feed stock to a router bit. The push shoe of the present invention enables the operator to adjust the shoe to varying stock width and thickness. The push shoe additionally has the ability to provide the operator with a miter gauge, a bit height measuring tool, a scale for use in common routing tasks, and a dovetail gauge.

The push shoe of the present invention has a miter bar which is stored in the push shoe base while the accessory is used as a push shoe. The push shoe has a bottom guard and a side guard which are adjustable in the horizontal and vertical direction respectively in order to compensate for varying stock thickness and height. The bottom guard and side guard may be completely removed from the push shoe so that the push shoe may be utilized as a miter gauge. The miter bar, which has a miter pointer at one distal end, may be removed from the base and affixed to the bottom of the push shoe. The push shoe base has an angle of deflection scale which the miter pointer is directed to, indicating to the operator which angle the miter bar is set at.

The invention itself, together with further objects and attendant advantages, will best be understood by reference to the following detailed description taken in conjunction with the accompanying drawings.

DETAILED DESCRIPTION OF THE PREFERRED EMBODIMENT

Figure 1:
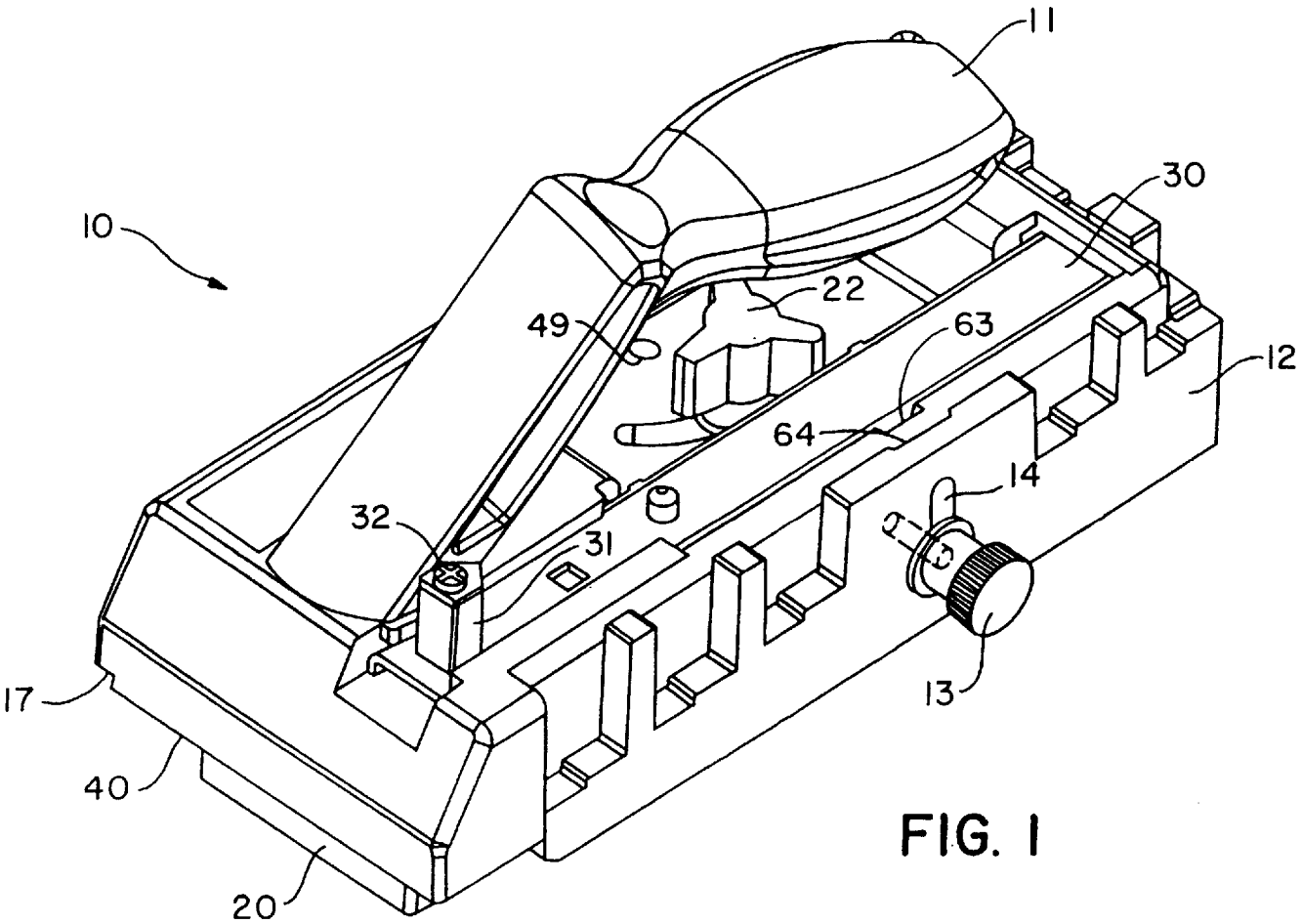
FIG. 1 is an isometric view of the router table push shoe of the present invention.
Figure 13:
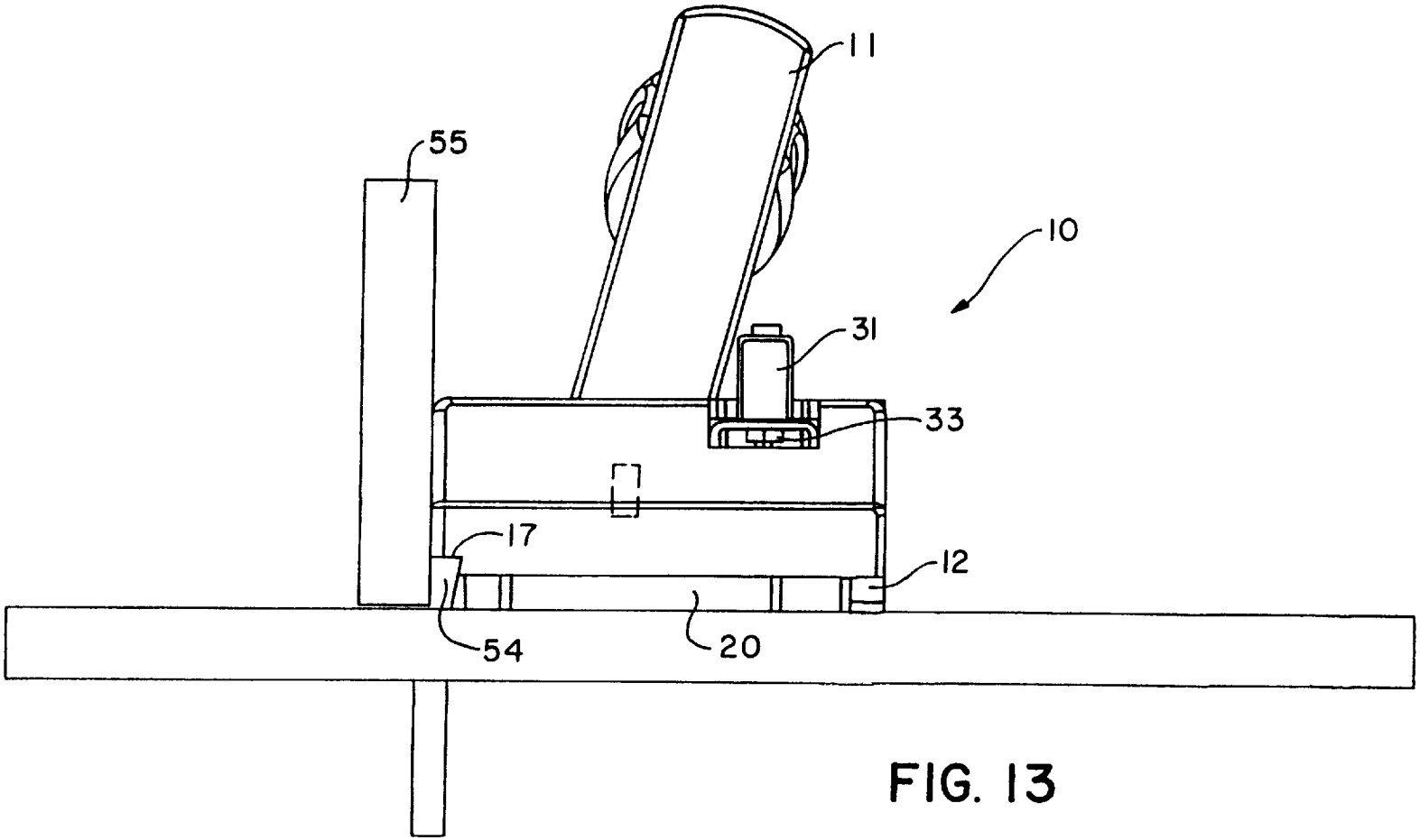

Turning now to the drawings, FIG. 1 shows the router table push shoe 10 of the present invention. The push shoe 10 has an upwardly extending handle 11 which is angled slightly towards the operator and away from the fence 55, as shown in FIG. 13. The push shoe of the present invention comes with an adjustable bottom guard 20 removably attached to a base 40, and an adjustable side guard 12 which can be removed and used as a bit height measuring tool. Both the bottom guard 20 and the side guard 12 are adjustable to enable the push shoe 10 to hold thin and narrow stock. The push shoe 10 also comes equipped with a miter bar 30, shown in FIG. 1 in the stored position, said miter bar 30 having a miter pointer 31 and an attachment screw 32. The horizontally adjustable bottom guard 20 is removably attached to the base 40 via a three wing knob 22. The push shoe also has formed in the front right corner a dovetail gauge 17 for making both male and female joints for sliding dovetail joints. All of these attachments allow the push shoe 10 to be used as a push shoe and also as a miter gauge, a depth of bit height reference, a scale to check distance from the router bit to the fence, and a gauge for making ½" thru dovetail joints.

Figure 2:
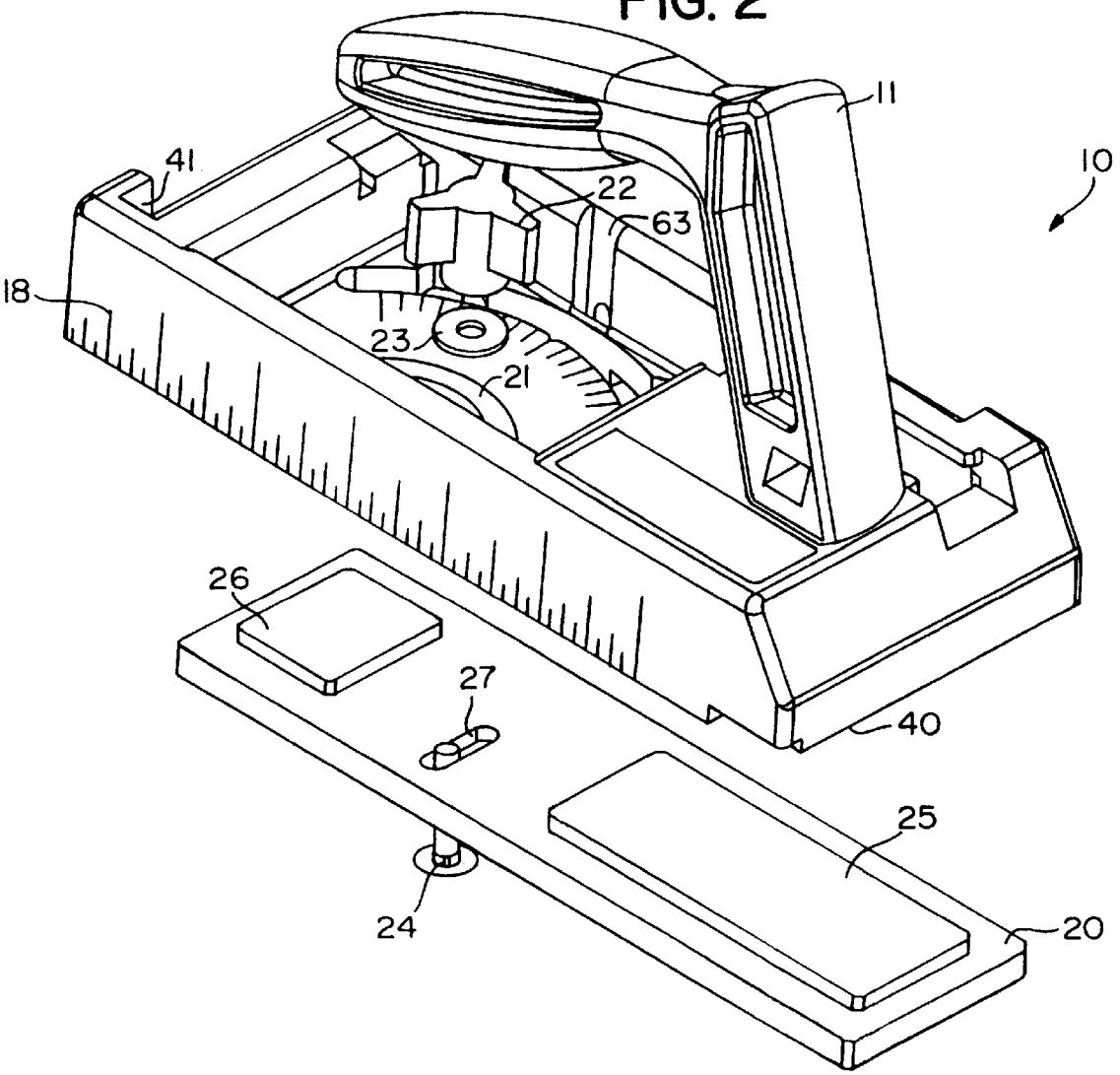
FIG. 2 is an isometric view of the router table push shoe of the present invention with the bottom guard removed from the push shoe.
Figure 5:
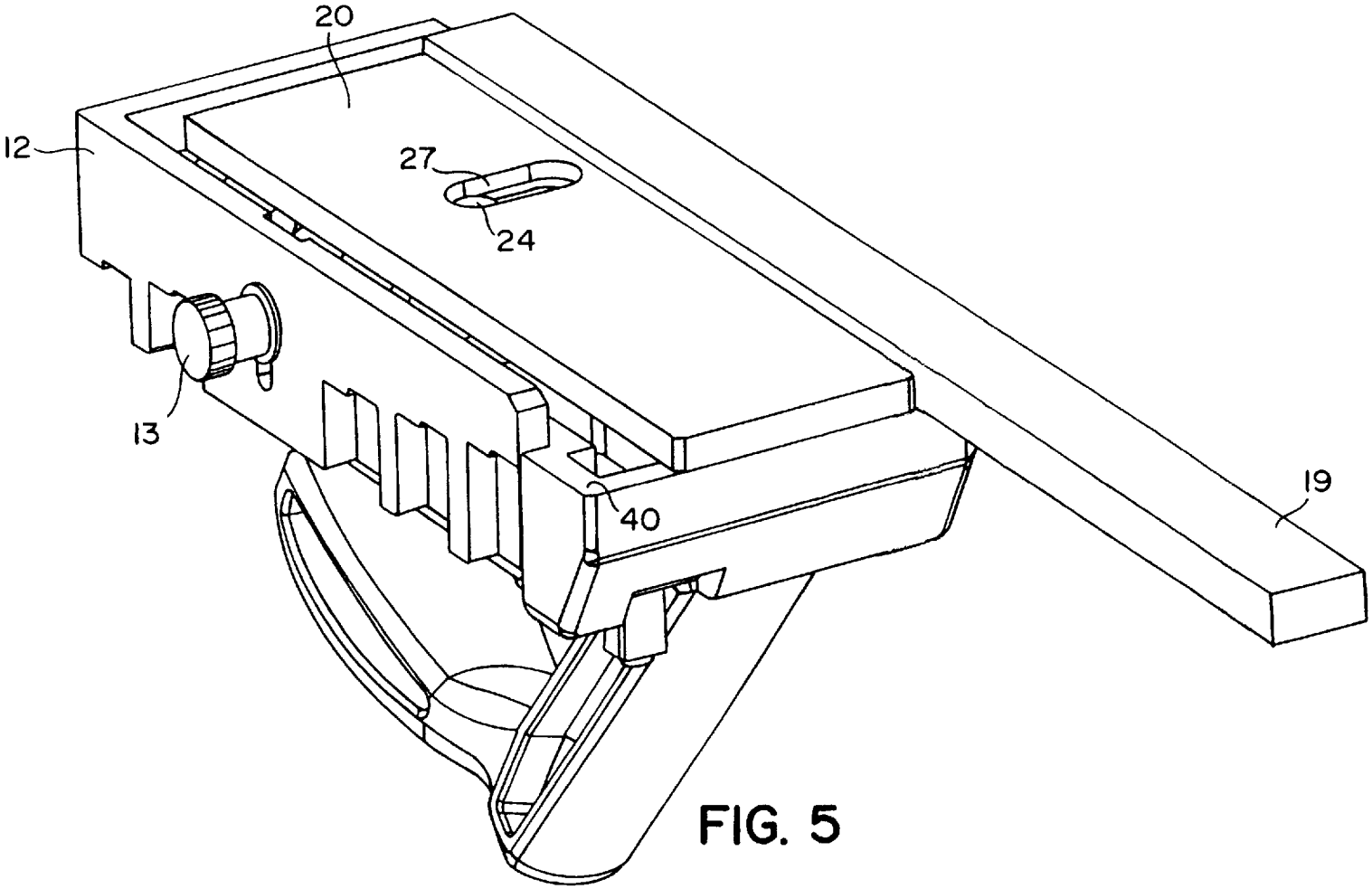
FIG. 5 is a bottom isometric view of the router table push shoe with a piece of stock inserted for proper feeding to a router bit.
Figure 6:
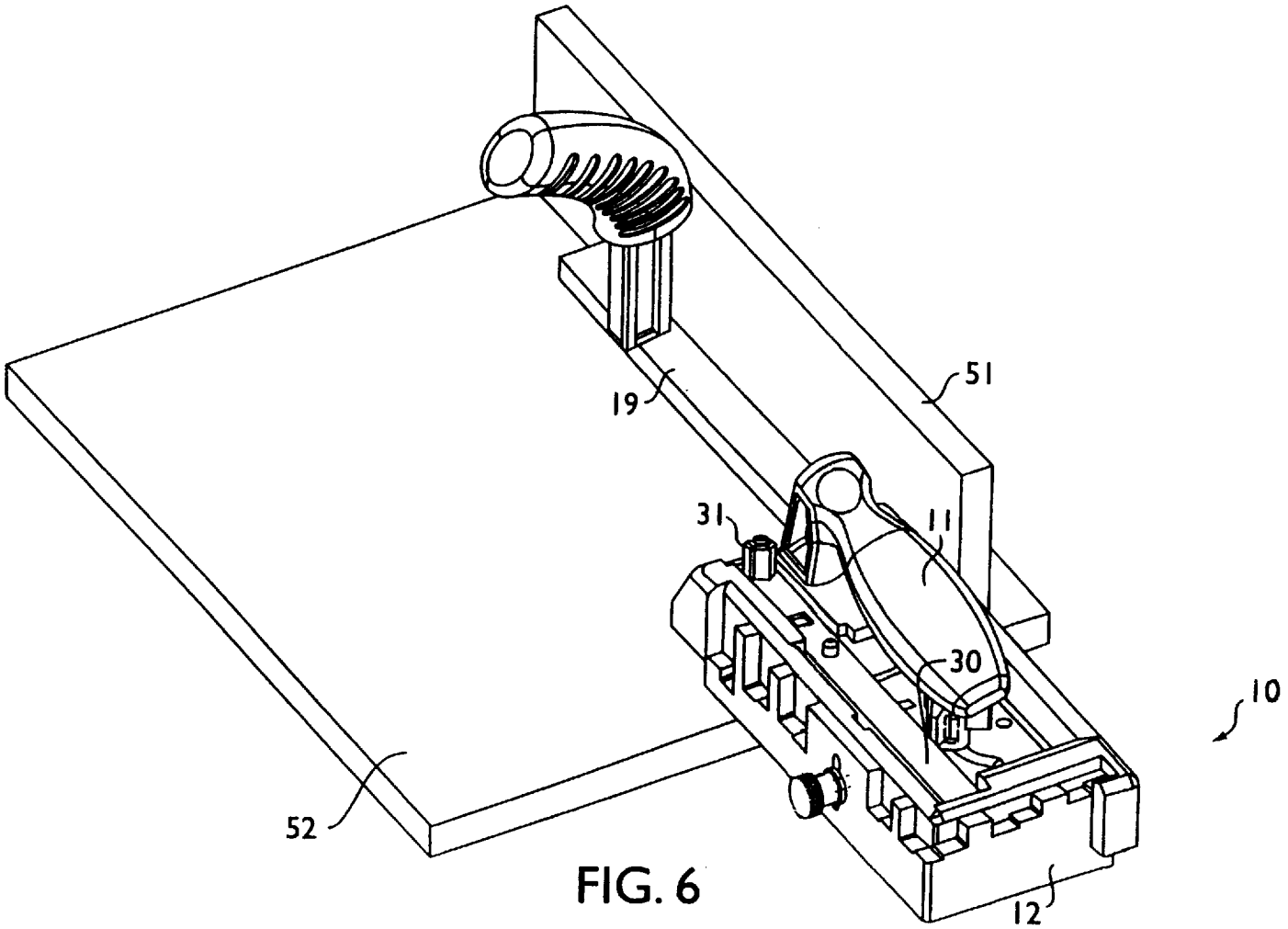
FIG. 6 is an isometric view of the router table push shoe of the present invention utilized to feed stock on a router table.

As shown in FIG. 2, the bottom guard 20 is detachable from the base 40 via a carriage bolt 24. The bottom guard 20 has a slot opening 27 allowing for lateral or horizontal adjustment of the bottom guard 20 for both wide and narrow stock. The carriage bolt 24 is received into a three wing knob 22. The carriage bolt 24 is inserted through the slot opening 27 which is formed in the bottom guard 20. The carriage bolt 24 is also inserted through an arc aperture 21 formed in the base 40. The slot opening 27 provides for lateral movement of the bottom guard 20 and provides a means for adjusting the bottom guard 20 for varying width stock. The bottom guard 20 has raised channel engaging members 25 and 26 configured to fit into receptive recesses 61 and 62, shown in FIG. 3, formed in the underside of the base 40. The channel engaging members 25 and 26 allow the bottom guard 20 to slide laterally allowing work-pieces or stock to abut next to the bottom guard 20 directly below a scale 18, as shown in FIG. 5 and 6. The three wing knob 22 allows for easy adjustment of the bottom guard 20 for such lateral movement.

Figure 3:
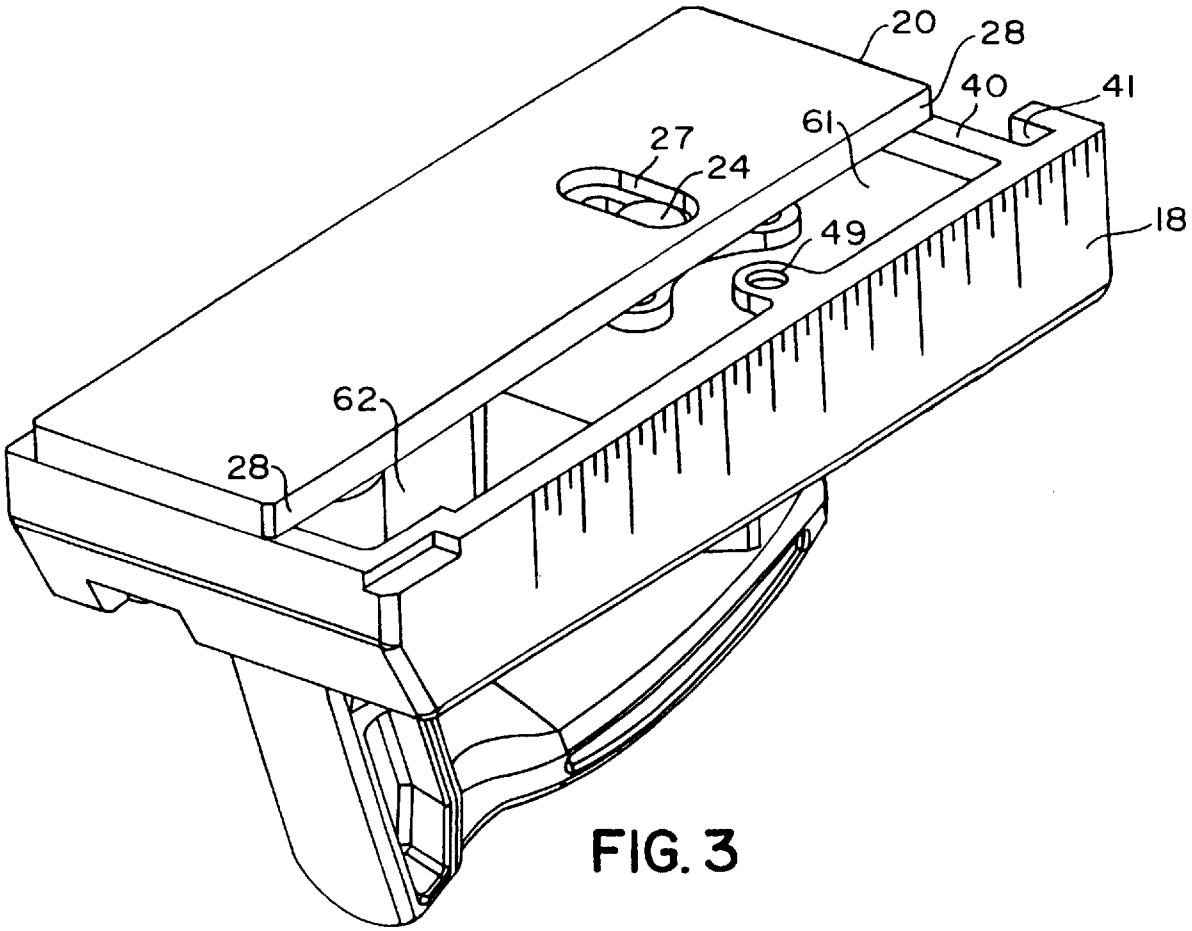
FIG. 3 is an isometric view of the bottom portion of the router table push shoe and bottom guard of the present invention.

As shown in FIG. 3, the bottom guard 20 is adjusted to allow stock to abut against a first side 28 of the bottom guard 20. Recess members 61 and 62 form a channel for receiving raised the channel engaging members 25 and 26 formed on the bottom guard 20. The base 40 provides an upper surface for engaging stock manipulated by the push shoe 10. The bottom guard 20 can slide laterally up to one half inch (½") providing a full one inch area to hold wider stock.

Figure 4:
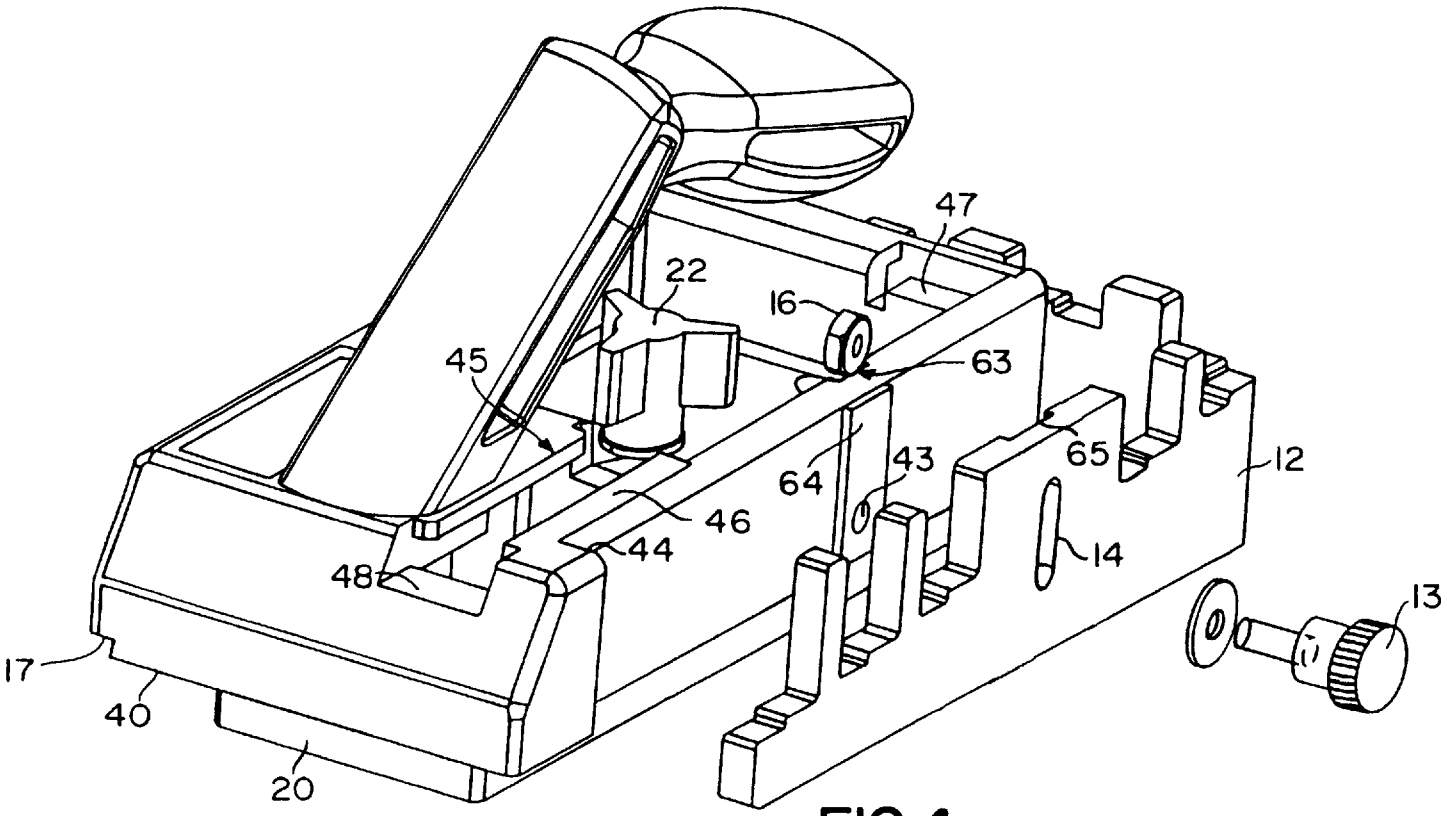
FIG. 4 is an isometric view of the router table push shoe of the present invention with the side guard removed from the push shoe.

Also shown in FIG. 3 is a corner receiving joint 41 for receiving the back leg of the side guard 12. The side guard 12, shown in FIG. 4, is vertically moveable via a round knob 13 which is received within a nut 16 located within a slot 63. The side guard 12 is vertically adjustable for differing thickness stock. The side guard 12 may be fully removed from the base 40 by removing the knob 13 and the nut 16. The side guard 12 is placed adjacent to the back corner of the push shoe 10 so that the back leg of the side guard fits within the corner receiving joint 41 of the push shoe 10. The front leg of the side guard 12 is placed against a recessed side portion 44, shown in FIG. 4, formed in the side of the push shoe 10 for receiving the side guard 12. The nut 16 is placed within a receiving slot 63 which impedes the rotation of the nut 16 when the round knob 13 is turned. The receiving slot 63 therefore is slightly larger in diameter than the nut 16 allowing the nut to drop within the receiving slot 63 in order to properly engage the threaded knob 13. The round knob 13 is inserted into a vertical slot 14 in the side guard and a through hole 43 in the base in order to properly secure the knob 13 into the threaded nut 16. The side guard 12 also has a recessed channel slot 65 for receiving a channel engaging member 64 formed on a second side of the push shoe 10. The channel engaging member 64 and the recessed channel slot 65 allow the side guard to move vertically upon loosening of the round knob 63. There is formed, therefore, a track for side guard 12 to move up and down on.

The side guard 12 is adjustable for varying thickness stock. If thin stock is to be manipulated by the push shoe, the knob 13 is loosened and the side guard 12 is moved to the upward most position. The side guard may be adjusted for thicker stock by lowering the side guard to the appropriate level. This adjustable side guard provides means for vertically adjusting the push shoe for varying size stock to be manipulated by the router bit.

As shown in FIG. 5, the side guard 12 and the bottom guard 20 have been adjusted to receive stock 19. The stock 19 abuts along its side against the bottom guard 20 and at its back against the side guard 12. The base 40 forms the upper contact surface against which the stock 19 rests upon. The push shoe 10 is then utilized to push the stock 19 directly forward without any sideways or lateral movement of the stock against a router bit. The bottom guard 20 has been properly adjusted via the carriage bolt 24 and the slot opening 27. The side guard 12 has been adjusted to the proper thickness via the knob 13 such that the height and thickness of the stock is matched by the push shoe guards 12, 20 and the base 40.

Shown in FIG. 6, the push shoe 10 is utilized to push the stock 19 against a router bit (not shown). The stock 19 is pushed along the fence 51 by the push shoe 10. The push shoe 10 is held by the operator by a handle 11 which is placed at an appropriate angle leaning towards the operator in order to ease its use and prevent an awkward holding angle by the operator. The side guard 12 is adjusted as previously shown. The stock 19 is pushed forward to be worked upon by the router bit in a secure and safe manner.

The push shoe 10 also has stored in the base 40 a miter bar 30 which has located at one end a miter pointer 31. The miter bar 30 slides onto the base 40 under lip members 45, 46, shown in FIG. 4. In the fully stored position, the miter bar 30 rests against a U-shaped end support channel 47 at the back end of the push shoe and a flat front support 48 at the front most position. The miter bar 30 is prevented from moving vertically by the lip members 45, 46. The miter bar 30 is shown in the stored position in FIG. 1 and FIG. 6.

Figure 7:
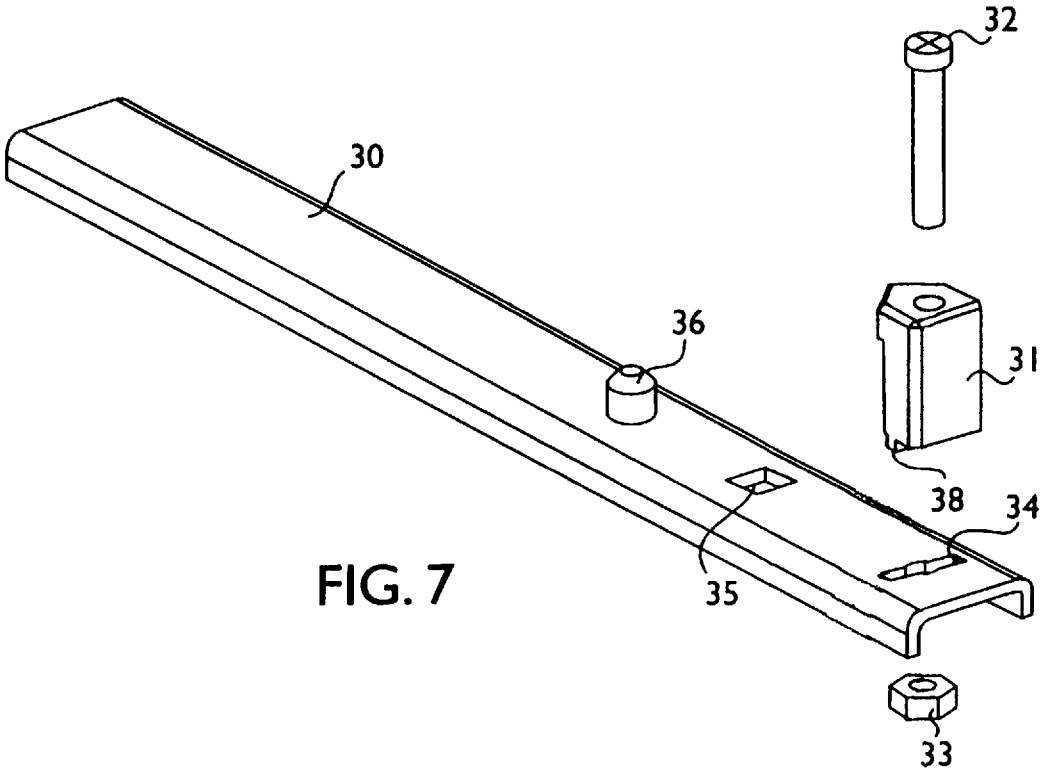
FIG. 7 is an isometric view of the miter bar of the router table push shoe of the present invention.
Figure 8:
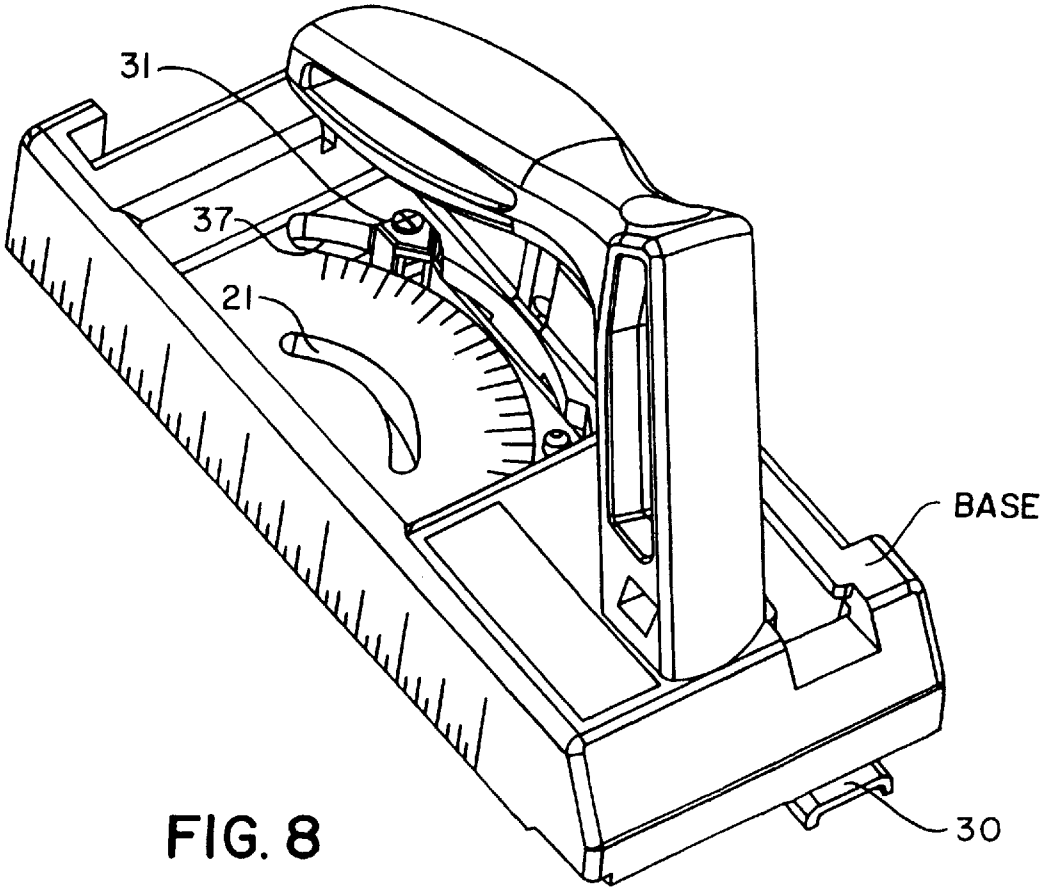
FIG. 8 is an isometric view of the router table push shoe of the present invention with the miter bar partially attached.
Figure 9:
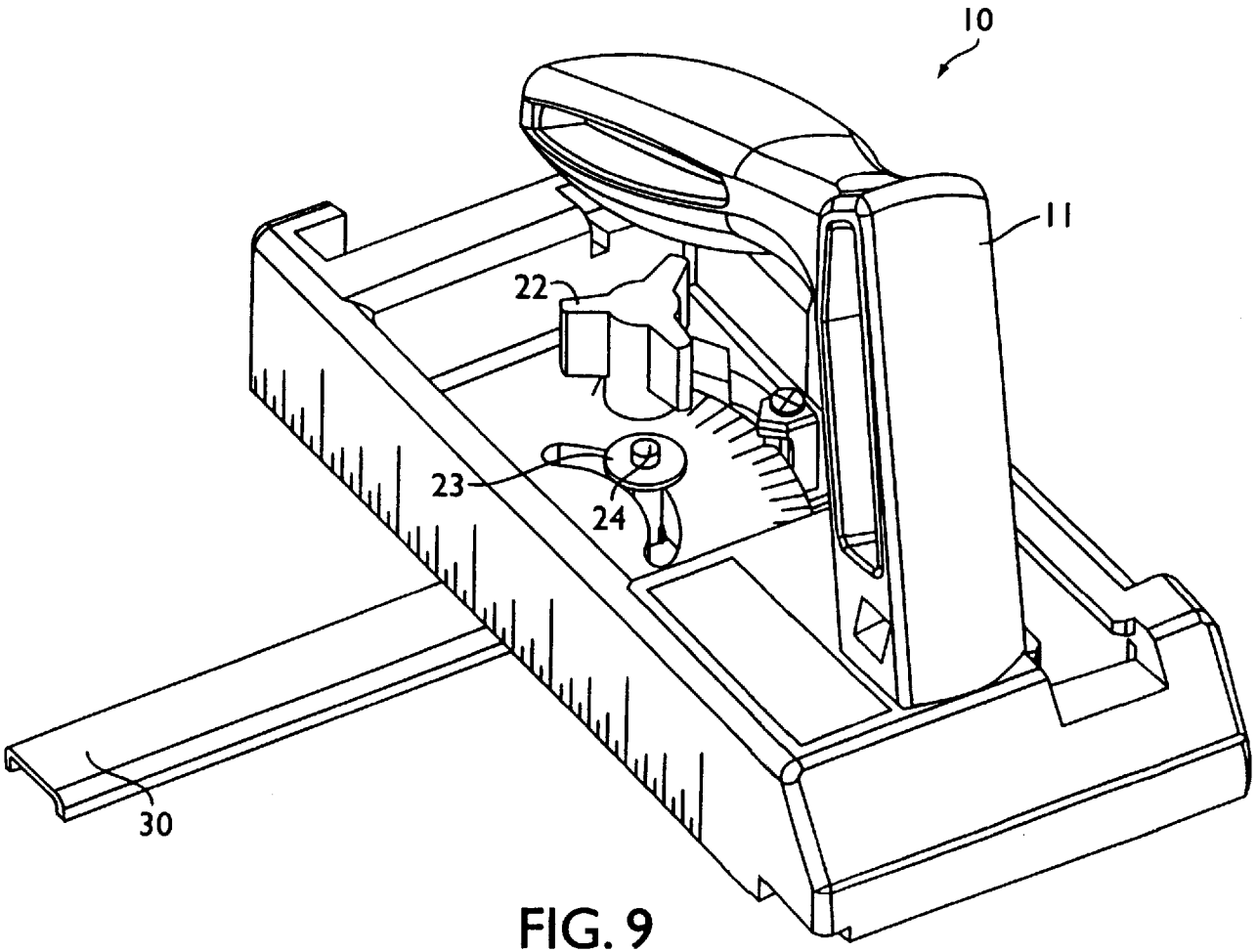
FIG. 9 is an isometric view of the router table push shoe of the present invention with the miter bar fully extended.

The push shoe 10 may alternatively be utilized as a miter pointer. The side guard 12 and the bottom guard 20 must be fully removed to use the miter bar 30. The unassembled miter bar 30 is shown in FIG. 7. A bolt 32 holds the miter pointer 31 to the bar 30 via a nut 33. The miter pointer 31 has a locking member 38 which fits into an opening 34 formed in the bar 30. A rotation pin 36 is provided for rotating the miter bar 30 about a central point under the push shoe. The rotation pin 36 is inserted into an aperture 49 formed on the underside of the push shoe 10, shown in FIG. 3, but only after removal of the bottom guard 20. The miter pointer 31 is inserted into a curved or arc opening 37 formed in the base 40 as shown in FIG. 8. The miter bar 30 is directed forward while inserting the pointer 31 through an insertion opening located within the curved opening 37. The miter bar 30 is then rotated about the rotation pin 36 until a desired angle, which is shown along the curved opening 37 and pointed to by the miter pointer 32, as shown in FIG. 9, is reached. When the desired angle is reached, the carriage bolt 24 and the three wing knob 22, received through an opening 35 in the bar 30 and through the arcuate aperture 21 formed in the base, are utilized to secure the miter bar 30 at the desired angle. The push shoe can then be used as a router table miter gauge which is fully adjustable between a 90° span, 45° in one direction off center and 45° in the opposite direction.

Figure 10:
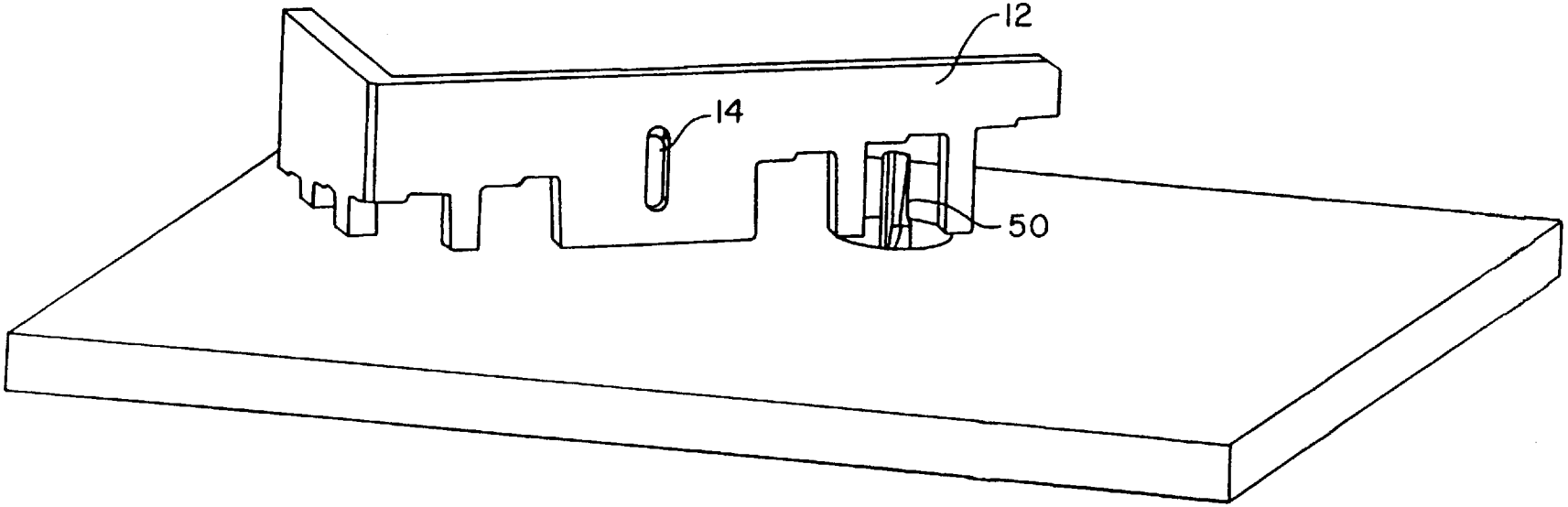
FIG. 10 is an isometric view of the side guard removed to act as a bit height measuring tool.

The side fence 12 may be removed from the push shoe 10 and used as a bit height gauge as shown in FIG. 10. Once removed, the side guard 12 must be inverted so that the numbers are right side up. The side fence may then be used to measure the router bit height, as shown.

Figure 11:
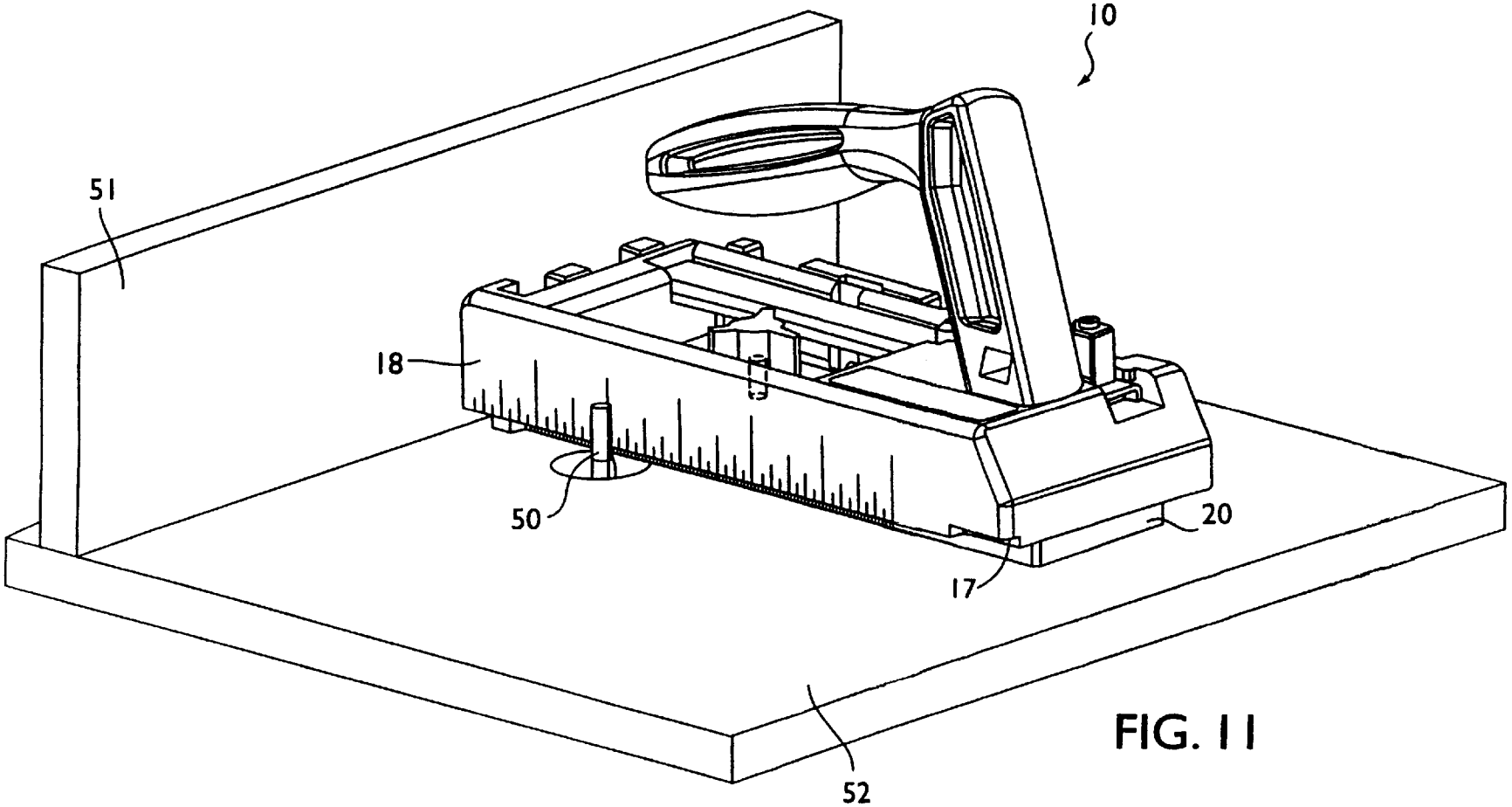
FIG. 11 is an isometric view of one side of the router table push shoe used to measure router bit distance from the fence.

Located on the first side of the base opposite the second side of the base where the side guard 12 is attached is located a six inch scale 18, as shown in FIG. 11, which can be used for several common routing tasks. With both the side guard 12 and the bottom guard 20 affixed to the push shoe 10, the scale 18 may be used to measure the router table fence offset distance. The push shoe 10 thus has means for measuring the offset distance between the fence 51 and the router bit 50 accurately using the scale 18 as shown.

Figure 12:
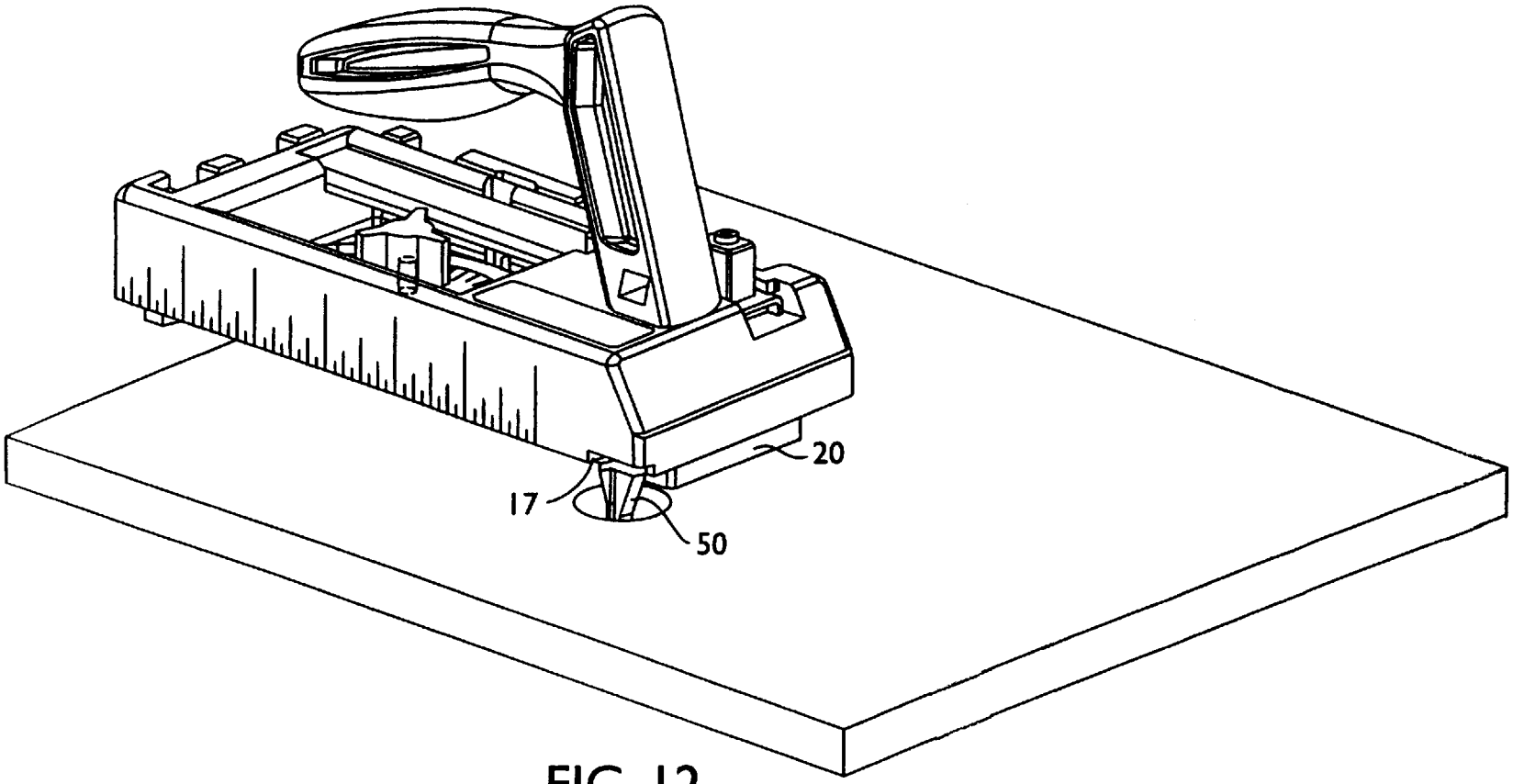
FIG. 12 is an isometric view of the router table push shoe of the present invention showing use of the dovetail gauge; and, FIG. 13 is a frontal view of the router table push shoe of the present invention showing use of the dovetail gauge.

It is often desirable to use a router table to create dovetail joints, with the router table used to create both the male (tenon) joint and the female (mortise) portion. The push shoe 10 has formed in the base 40 a dovetail gauge 17 as shown in FIG. 12. The dovetail gauge 17 is designed for ½ inch sliding dovetail joints to be made on a router table. The gauge 17 is designed for use on ¾ inch thick stock when making the male (tenon) portion of the joint. If the stock is not ¾ inch thick, the router table fence will have to be adjusted to make the joint fit together correctly. To use the push shoe to create the female (mortise) portion of the joint, the side guard 12 must be placed in the fully up position so that the push shoe is resting on the bottom guard 20. The dovetail gauge 17 must then be placed over the router bit 50 and the bit raised until it touches the top of the dovetail gauge 17 as shown in FIG. 12. The female portion of the joint may now be cut by pushing the stock forward against the bit.

To utilize push shoe 10 to cut the male portion of the joint, the side guard 12 must be placed in the fully up position so that the push shoe is resting on the bottom guard 20. The push shoe is then positioned over the dovetail bit 54 as shown in FIG. 13. The dovetail bit 54 is then raised so that it touches the top and side of the gauge, and the fence 55 is moved so that it touches the side of the shoe as shown in FIG. 13. The male portion of the joint may now be cut matching the female portion of the joint formed as previously described.

of course, it should be understood that a wide range of changes and modifications can be made to the preferred embodiment described above. It is therefore intended that the foregoing detailed description be understood that it is the following claims, including all equivalents, which are intended to define the scope of this invention.

We claim:

1. A router table push shoe comprising: a bottom guard and a side guard removably attached to a base;

the bottom guard being adjustable in a horizontal direction in comparison to the base; and the side guard being adjustable in a vertical direction in comparison to the base.

2. The router table push shoe of claim 1 further comprising:

a handle attached to an upper surface of the base.

3. The router table push shoe of claim 1 further comprising:

the bottom guard removably attached to the base by a member; and the member inserted through a slot opening in the bottom guard allowing for lateral or horizontal adjustment of the bottom guard.

4. The router table push shoe of claim 3 further comprising:

raised channel engaging members formed in the bottom guard configured to fit into receptive recesses formed in an underside of the base.

5. The router table push shoe of claim 1 further comprising:

the side guard being attached to the base adjacent to a back corner of the push shoe so that a back leg of the side guard fits within a corner receiving joint formed on the base;

a front leg of the side guard fits against a recessed side portion formed in a second side of the base.

6. The router table push shoe of claim 5 further comprising:

a recessed channel slot formed on the side guard for receiving a channel engaging member formed on the second side of the base; and the channel engaging member and the recessed channel slot configured to allow the side guard to move vertically.

7. The router table push shoe of claim 1 further wherein:

the adjustable side guard capable of being used as a bit height measuring tool.

8. The router table push shoe of claim 1 further comprising:

a measuring scale formed on a first side of the base opposite a second side of the base upon which the adjustable side guard is removably attached.

9. The router table push shoe of claim 1 further comprising:

a dovetail gauge formed in the base.

10. A router table push shoe comprising:

a bottom guard and a side guard removably attached to a base;

wherein the bottom guard being adjustable in a horizontal direction in comparison to the base, and the side guard being adjustable in a vertical direction in comparison to the base; and a miter bar capable of being both removably stored in the base and removably attached to the base in order to configure the miter table push shoe for utilization as a miter gauge.

11. The router table push shoe of claim 9 further comprising:

the base configured so that when the miter bar is stored in the base a back end of the miter bar contacts the base at a U-shaped end support channel formed in the base, a forward end of the miter bar contacts the base at a flat front support formed in the base and an upper surface of the miter bar contacts lip members formed in the base; and the lip members preventing the miter bar from moving vertically when stored.

12. The router table push shoe of claim 9 further wherein:

the miter bar comprises;

a bar;

a miter pointer attached to the bar; and a rotation pin attached to the bar.

13. The router table push shoe of claim 11 further wherein:

the router table push shoe when configured to be utilized as a miter gauge having:

the bottom guard and the side guard removed;

the rotation pin received in an aperture formed on an underside of the base;

the miter pointer received in an arc opening formed in the base; and a member for holding the miter bar in place received through an opening formed in the base and an opening in the bar.

14. A router table push shoe comprising:

a bottom guard and a side guard removably attached to a base;

wherein the bottom guard being adjustable in a horizontal direction in comparison to the base, and the side guard being adjustable in a vertical direction in comparison to the base;

a miter bar capable of being both removably stored in the base and removably attached to the base to configure the router table push shoe for utilization as a miter gauge;

a dovetail gauge formed in the base;

a scale formed on the base; and a bit height gauge formed in the side guard.

* * * * *